US011090707B2

(12) United States Patent
Unger

(10) Patent No.: US 11,090,707 B2
(45) Date of Patent: Aug. 17, 2021

(54) FEMALE DIE FOR A JOINING TOOL

(71) Applicant: Eckold GmbH & Co. KG, St. Andreasberg (DE)

(72) Inventor: Florian Unger, Bad Lauterberg (DE)

(73) Assignee: ECKOLD GMBH & CO. KG, St. Andreasberg (DE)

( * ) Notice: Subject to any disclaimer, the term of this patent is extended or adjusted under 35 U.S.C. 154(b) by 253 days.

(21) Appl. No.: 16/266,810

(22) Filed: Feb. 4, 2019

(65) Prior Publication Data

US 2019/0247908 A1 Aug. 15, 2019

(30) Foreign Application Priority Data

Feb. 14, 2018 (DE) ..... 10 2018 103 309.5

(51) Int. Cl.
*B21D 39/03* (2006.01)
*B21D 37/10* (2006.01)

(52) U.S. Cl.
CPC ..... *B21D 39/031* (2013.01); *B21D 37/10* (2013.01)

(58) Field of Classification Search
CPC ..... B21D 37/10; B21D 39/031; B21D 39/032
USPC ..... 72/462, 466.5, 470, 474, 476; 29/521
See application file for complete search history.

(56) References Cited

U.S. PATENT DOCUMENTS 5,339,509 A * 8/1994 Sawdon ..... B21D 39/031 29/432
9,050,645 B2 * 6/2015 Dubugnon ..... B21D 39/031
9,610,627 B2 4/2017 Unger
2004/0045153 A1 * 3/2004 Rapp ..... B21D 39/035 29/521
2004/0261486 A1 * 12/2004 Kuhne ..... B21D 39/031 72/353.6

(Continued)

FOREIGN PATENT DOCUMENTS

CN 106256461 12/2016
DE 10116736 4/2002

(Continued)

OTHER PUBLICATIONS

Chinese Office Action in related CN application No. 201910111715.7 dated Nov. 24, 2020, 6 pages.

(Continued)

*Primary Examiner* — Adam J Eiseman
*Assistant Examiner* — Bobby Yeonjin Kim
(74) *Attorney, Agent, or Firm* — Andrew M. Calderon; Roberts Calderon Safran & Cole, P.C.

(57) ABSTRACT

A female die for a joining tool having an anvil and a shoulder which coaxially surrounds the anvil and which is configured on a main body of the anvil or by an end of a bush, and a sleeve which surrounds the main body or the bush, respectively, and which across the circumference thereof has radial slots penetrating the wall of said sleeve, in each case one sliding piece being guided in said slots so as to be movable in the radial direction (R), said sliding piece in the axial direction (A) being supported at least on the shoulder, is distinguished in that the wall of the sleeve on that end that surrounds the shoulder in the region between the slots has regions which widen in a radially inward manner and which extend in each case between two neighboring sliding pieces and in the radial direction (R) at least in part protrude beyond the shoulder.

19 Claims, 5 Drawing Sheets

(56) References Cited

U.S. PATENT DOCUMENTS

| | | | | |
|---|---|---|---|---|
| 2006/0168792 | A1* | 8/2006 | Reatherford | B21D 39/031 29/514 |
| 2006/0196034 | A1* | 9/2006 | Sawdon | B21D 39/031 29/521 |
| 2010/0212131 | A1* | 8/2010 | Sawdon | B21D 39/031 29/243.5 |
| 2016/0368038 | A1* | 12/2016 | Unger | B21J 15/36 |

FOREIGN PATENT DOCUMENTS

| | | |
|---|---|---|
| DE | 102004033228 | 2/2006 |
| EP | 1468758 | 10/2004 |
| EP | 2138249 | 12/2009 |
| WO | 0136124 | 5/2001 |

OTHER PUBLICATIONS

European Search Report in related EP application No. 19152135 dated Jul. 4, 2019, 6 pages.

* cited by examiner

FEMALE DIE FOR A JOINING TOOL

FIELD OF THE INVENTION

The invention relates to a female die for a joining tool, in particular for clinching, having an anvil and a shoulder which coaxially surrounds the anvil and which is configured on a main body of the anvil or by an end of a bush, and a sleeve which surrounds the main body or the bush, respectively, and which across the circumference thereof has radial slots penetrating the wall of said sleeve, in each case one sliding piece being guided in said slots so as to be movable in the radial direction, said sliding piece in the axial direction being supported at least on the shoulder.

DISCUSSION OF BACKGROUND INFORMATION

Such a female die is known from EP 1 468 758 B1, for example. Guide tracks for the sliding pieces are achieved by the slots in the shell of the sleeve, said sliding pieces on account of said guide tracks, besides the support face on the shoulder of the main body, receiving additional guiding. Such a female die in terms of the height thereof and the diameter thereof is of compact construction. The female die interacts with a tool die and serves, conjointly with the tool die, for connecting two joining parts, for example metal sheets, to one another by forming the material. High forces act on the female die in particular in clinching. The counter tool used for joining is composed of a downholder and a die. While the die acts on the main body or the anvil, respectively, the downholder is supported on the sleeve. In order for sufficiently high forces to be able to be transmitted, the sleeve has to be composed of a hard and tough material which not only is associated with the disadvantage of correspondingly high costs but is also relatively difficult to machine, this in turn requiring high-quality tools for incorporating the slots in the wall of the sleeve, such that the production of the sleeve is correspondingly cost-intensive and time-consuming.

Similar female dies are known from DE 10 2004 033 228 A1 or DE 101 16 736 A1. Here however, neither is the anvil provided with the shoulder nor is a sleeve disposed in the main body. The main body is configured so as to be integral, and the sliding pieces slide exclusively in the slots on bearing faces provided in the main body, or in grooves provided in the anvil, respectively.

SUMMARY OF THE INVENTION

Proceeding from this set of problems, the female die described at the outset is to be improved such that the forces that are able to be transmitted by the sleeve can be increased and either cost-effective material can be used or higher down-holding forces can be absorbed on account thereof.

In order for the object to be achieved, a generic female die is distinguished in that the wall of the sleeve on that end that surrounds the shoulder in the region between the slots has regions which widen in a radially inward manner and which extend in each case between two neighboring sliding pieces and in the radial direction at least in part protrude beyond the shoulder.

On account of this design embodiment, the downholder when joining bears on a large area, on account of which the sleeve can absorb higher forces and the loading of said sleeve is reduced by the force of the downholder.

The sliding pieces in the cross section are preferably configured so as to be L-shaped having a foot and a head, and the slots in the axial direction have an upper wall and a lower wall. On account of this design embodiment, the guiding of the sliding pieces in the sleeve is ensured.

When the feet of the sliding pieces in the radial direction have a groove, and the wall of the sleeve level in height with the slots is provided with a circumferential groove, a spring element that encompasses all sliding pieces can be placed in the groove, said spring element effecting the restoring forces on the sliding pieces. The spring element can be a steel annular spring or a polymer spring.

The widened regions of the sleeve preferably begin at the height level of the lower walls of the slots. On account thereof, the regions which can serve for force transmission are optimized.

In order for the guiding of the sliding pieces to be further improved, at least one of the walls of the slots can have a guide element, and the associated sliding piece in a manner congruent thereto can have a counter guide. This guide/counter guide can be implemented by protrusions and grooves.

When the wall of the sleeve protrudes beyond the sliding pieces in the axial direction, radially continuous axial milled grooves are provided above the slots. It is ensured on account of this embodiment that the force of the downholder is introduced into the widened regions of the wall even when the female die, or the sleeve, respectively, is not disposed so as to be absolutely parallel to the joining parts but is at a slight angle to the latter, such that no fully planar contact is attained on the lower side of the workpiece.

On account of the force that is absorbable by the sleeve being increased, dissimilar materials can be chosen for the anvil and the sleeve, wherein the anvil is composed of a harder material than the sleeve. The anvil can be fixed, or be driven in the axial direction.

BRIEF DESCRIPTION OF THE DRAWINGS

Exemplary embodiments of the invention are to be described in more detail hereunder with the aid of a drawing in which.

DETAILED DESCRIPTION

Figure 1:
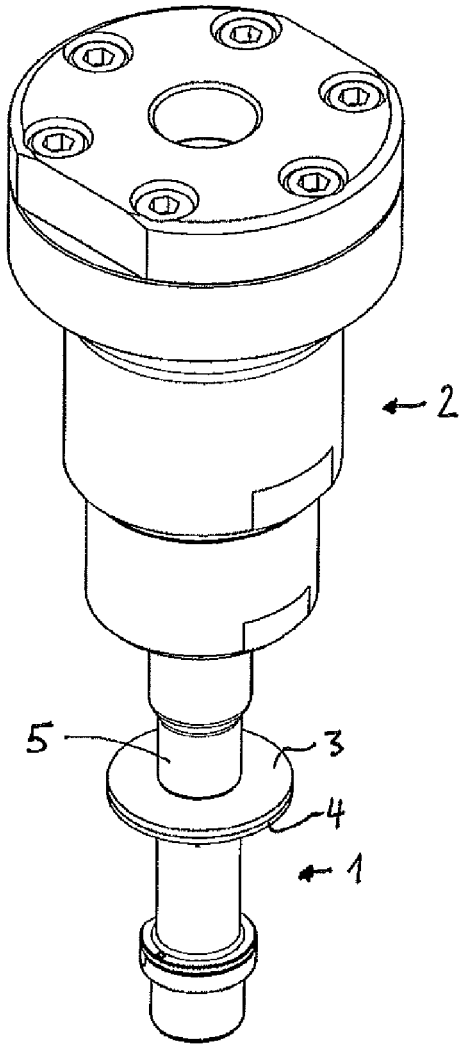
FIG. 1—shows the assembly of a joining device.
Figure 2:
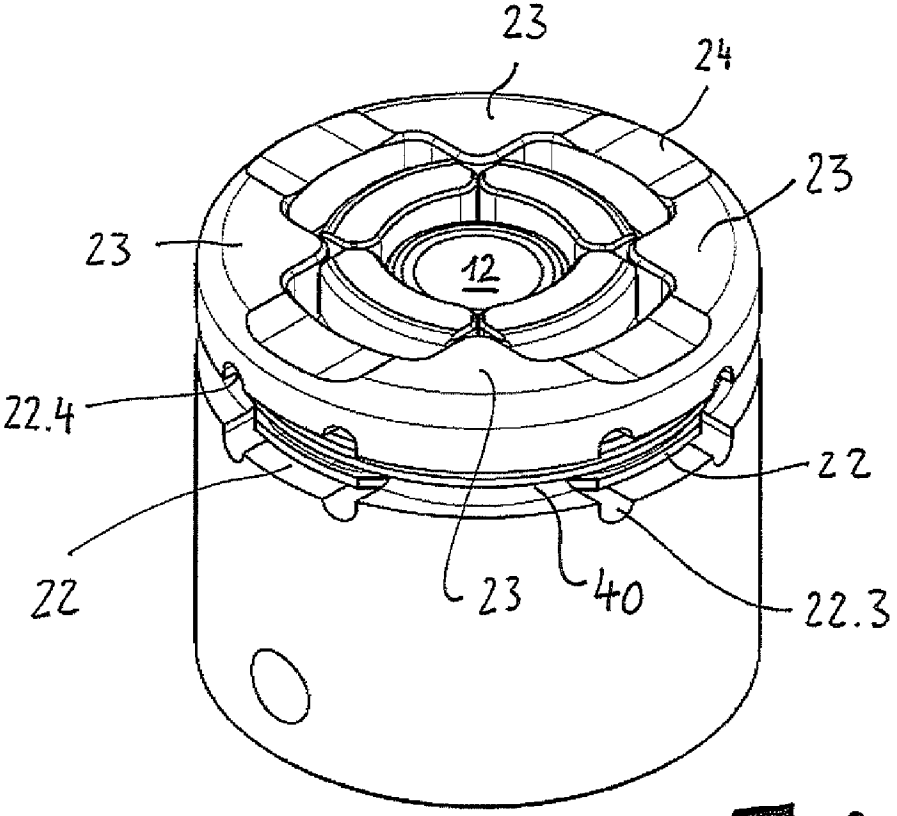
FIG. 2—shows a first exemplary embodiment of a female die in a perspective illustration.
Figure 3:
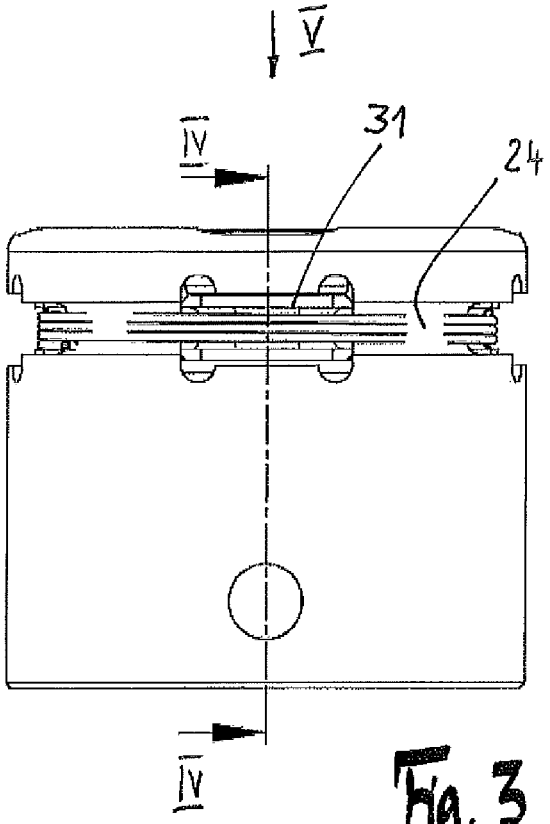
FIG. 3—shows the view of the female die according to FIG. 2.
Figure 4:
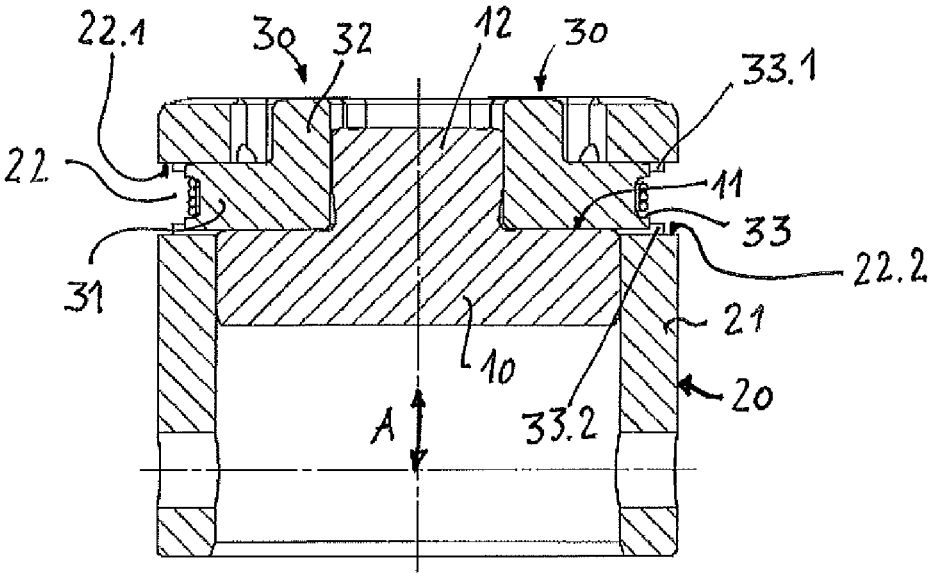
FIG. 4—shows the section along the line IV-IV according to FIG. 3.
Figure 5:
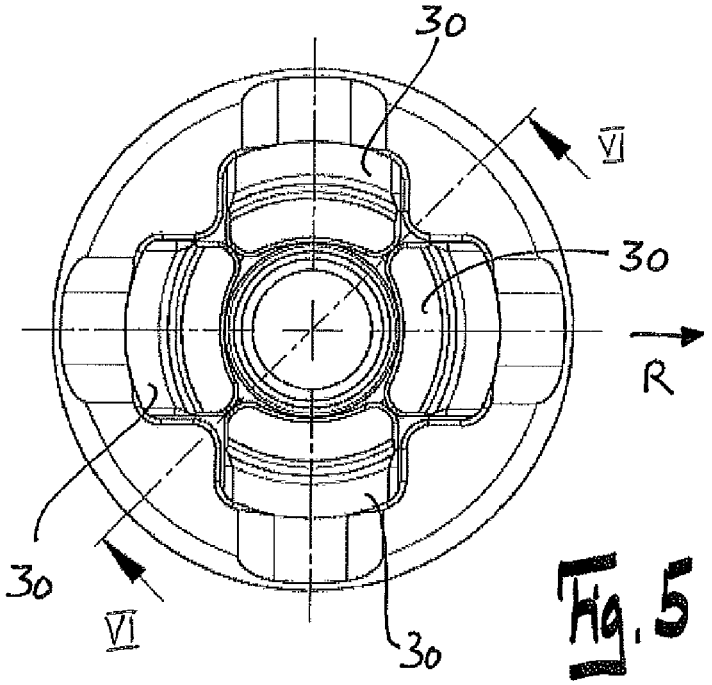
FIG. 5—shows the view according to the viewing arrow V according to FIG. 3.
Figure 6:
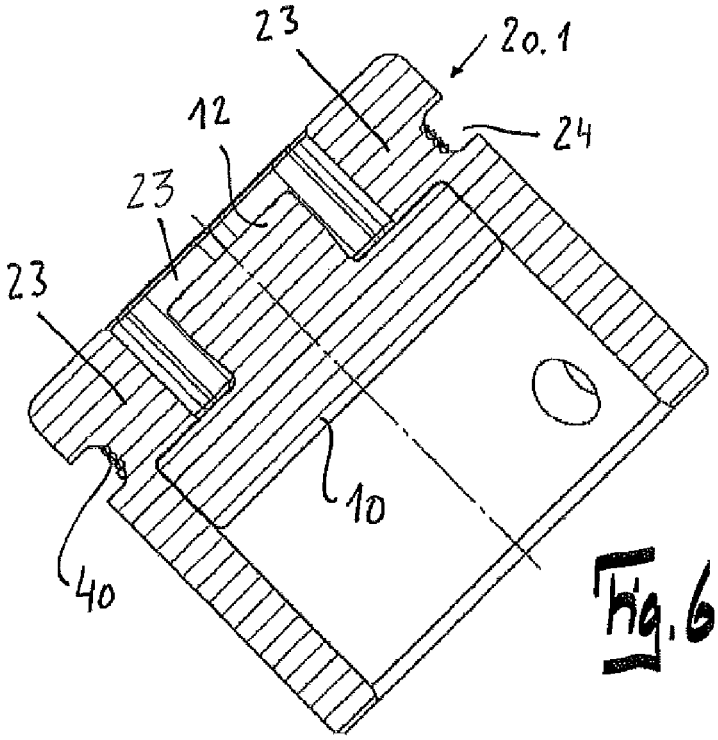
FIG. 6—shows the section along the line VI-VI according to FIG. 5.

The joining tool is composed substantially of the female die 1 and the tool carrier 2 disposed thereabove and serves for connecting the two metal sheets 3, 4 to another by forming. A die which is coaxially surrounded by the downholder 5 is disposed in the tool carrier 2 (not illustrated here). The downholder 5 when joining is supported on the upper metal sheet 3, while the die effects the deformation of the two metal sheets 3, 4 and connects the metal sheets 3, 4 to one another in punctiform manner.

Figure 8:
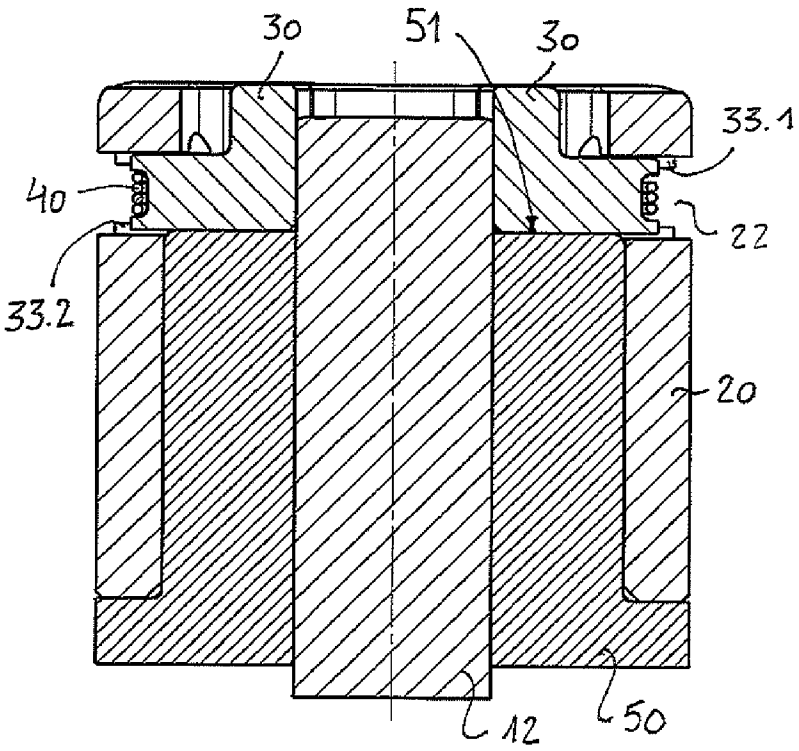
FIG. 8—shows the section along the line VIII-VII according to FIG. 7.
Figure 7:
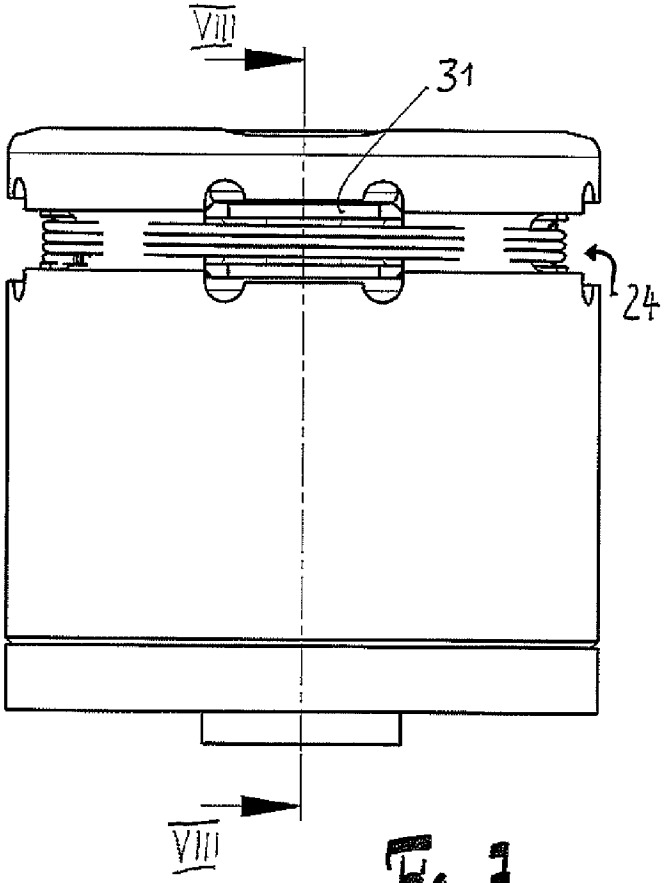
FIG. 7—shows the view of a second exemplary embodiment of a female die.

The female die 1 is composed of the main body 10 on which an upper encircling shoulder 11 which is coaxially adjoined by an anvil 12 is configured, and of the sleeve 20 having sliding pieces 30 disposed thereon. The main body 10 can be fixedly assembled in the sleeve 20 or be driven so as to be displaceable in the axial direction A. When the anvil 12 is disposed so as to be displaceable in the axial direction A, said anvil 12 is surrounded by an additional bush 50 (FIG. 8). The following applies to both embodiments. The sliding pieces 30 in the cross section are configured so as to be L-shaped having a foot 31 and a head 32. Slots 22 which are continuous in the radial direction R and in which the feet 31 of the sliding pieces 30 are received in a sliding manner are provided in the wall 21 of the sleeve 20, the number of said slots 22 corresponding to the number of the sliding pieces 30. The wall 21 of the sleeve 20, so as to be level in height with the slots 22, is provided with an external circumferential groove 23 into which the slots 22 open out. The feet 31 of the sliding pieces 30 have a groove 33 in which a spring element 40, for example a steel annular spring or a polymer element, is placed, said spring element 40 urging the sliding pieces 30 radially inward such that said sliding pieces 30 in the non-stressed state lean on the anvil 12 and bear on the shoulder 11.

In the case of the embodiment having a stationary anvil 12, the task of the shoulder 11 is assumed by the bush 50, or the upper end 51 thereof, on which the sliding pieces 30 slide.

The wall 21 of the sleeve 20 in the region of the upper end 20.1 thereof between the slots 22 is widened in a radially inward manner such that widened regions 23 result which extend in each case between two neighboring sliding pieces 30 and in the radial direction R protrude beyond the shoulder 11 of the main body 10, or the shoulder 51 configured by the upper end of the bush 50, respectively. The downholder 5 which acts on the metal sheets 3, 4 is supported in these widened regions 23 of the sleeve 20 of the female die 1. When the die further deforms the metal sheets 3, 4 in the axial direction, said die is supported on the anvil 12 and the material displaced from the metal sheets 3, 4 forces the main body 10 downward in the axial direction A and the sliding pieces 30 outward in the radial direction R, counter to the force of the spring element 40. The spring elements 30 herein slide in the slots 22 and are supported on the shoulder 11 of the main body 10.

Grooves 22.3, 22.4 are provided in the upper wall 22.1 and the lower wall 22.2 of the slots 22, protrusions 33.1, 33.2 provided on the feet 31 of the sliding pieces 30 being guided in a sliding manner in said grooves 22.3, 22.4.

The sleeve 20 above the slots 22 is provided with axial milled grooves 24 which are embodied so as to be continuous, on account of which the widened regions 33 protrude upward. It is thus ensured that the female die 1, or the sleeve 20, respectively, always bears on the lower side of the metal sheet 4 by way of the widened regions 23 even when the female die 1 is not aligned so as to be exactly plane-parallel to the metal sheet 4. Overloading of the wall 21 in the region of the slots 22 is reliably avoided on account thereof, because no force by way of the downholder 5 can act on said wall 21.

The invention claimed is:

1. A female die for a joining tool comprising an anvil and a shoulder which coaxially surrounds the anvil and which is configured on a main body of the anvil or by an end of a bush, and a sleeve which surrounds the main body or the bush, respectively, and which across a circumference thereof has radial slots penetrating a wall of said sleeve, in each case one sliding piece being guided in said radial slots so as to be movable in a radial direction (R), said sliding piece in an axial direction (A) being supported at least on the shoulder, wherein the wall of the sleeve has regions which widen in a radially inward manner that cover the shoulder in the axial direction in the region between the slots and which extend in each case between two neighboring sliding pieces and in the radial direction (R) at least in part protrude beyond the shoulder.

2. The female die according to claim 1, wherein the sliding pieces in the cross section are configured so as to be L-shaped having a foot and a head, and the slots in the axial direction (A) have an upper wall and a lower wall.

3. The female die according to claim 2, wherein the feet of the sliding pieces in the radial direction (R) have a groove, and the wall of the sleeve level in height with the slots has a circumferential groove, and a spring element that encompasses all sliding pieces is placed in the grooves.

4. The female die according to claim 2, wherein the widened regions begin at a height level of the lower walls of the slots.

5. The female die according to claim 1, wherein the sliding pieces are guided in the slots.

6. The female die according to claim 5, wherein at least one of the upper and lower walls the slots has a guide element, and the associated sliding piece in a manner congruent thereto has a counter guide.

7. The female die according to claim 1, wherein the wall of the sleeve in the axial direction (A) terminates conjointly with the sliding pieces or protrudes beyond the latter, and in the region above slots has continuous axial milled grooves.

8. The female die according to claim 3, wherein the spring element is a steel annular spring or a polymer spring.

9. The female die according to claim 1, wherein the anvil is composed of a harder material than the sleeve.

10. The female die according to one claim 1, wherein at least three sliding pieces are provided.

11. The female die according to claim 1, wherein the anvil is configured to be driven so as to be displaceable in the vertical direction (V).

12. The female die according to one claim 1, wherein four sliding pieces are provided.

13. The female die according to one claim 1, wherein the joining tool is configured for clinching.

14. The female die of claim 1, wherein the shoulder is an upper encircling shoulder which is coaxially adjoined by the anvil, and of the sleeve having the sliding piece disposed thereon.

15. The female die of claim 1, wherein the radial slots correspond to a number of the sliding piece.

16. The female die of claim 1, wherein the wall of the sleeve is provided with an external circumferential groove into which the radial slots open out.

17. The female die of claim 16, wherein the wall of the sleeve in a region of an upper end thereof between the radial slots is widened in the radially inward manner.

18. The female die of claim 1, further comprising grooves in an upper wall and lower wall of the radial slots and protrusions provided on feet of the sliding piece guided in a sliding manner in the grooves.

19. The female die of claim 1, wherein the main body is fixedly assembled in the sleeve or be driven so as to be displaceable in the axial direction A.

* * * * *